US007071810B2

(12) United States Patent
Ma et al.

(10) Patent No.: US 7,071,810 B2
(45) Date of Patent: Jul. 4, 2006

(54) OVER-CURRENT PROTECTION APPARATUS

(75) Inventors: Yun Ching Ma, Pingtung (TW); Ching Han Yu, Hualien (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 11/005,533

(22) Filed: Dec. 6, 2004

(65) Prior Publication Data

US 2005/0141160 A1 Jun. 30, 2005

(30) Foreign Application Priority Data

Dec. 31, 2003 (TW) ..... 92137718 U

(51) Int. Cl.
*H01C 7/10* (2006.01)

(52) U.S. Cl. ..... 338/21

(58) Field of Classification Search ..... 338/22 R, 338/22 SD, 320, 328, 203
See application file for complete search history.

(56) References Cited

U.S. PATENT DOCUMENTS

| | | | | |
|---|---|---|---|---|
| 4,196,411 | A * | 4/1980 | Kaufman | 338/314 |
| 5,852,397 | A | 12/1998 | Chan et al. | |
| 6,023,403 | A | 2/2000 | McGuire et al. | |
| 6,040,755 | A * | 3/2000 | Abe et al. | 338/22 R |
| 6,317,023 | B1 * | 11/2001 | Felten | 338/254 |
| 6,377,467 | B1 | 4/2002 | Chu et al. | |
| 6,429,533 | B1 * | 8/2002 | Li et al. | 257/783 |
| 6,838,972 | B1 * | 1/2005 | Minervini et al. | 338/22 R |
| 6,873,244 | B1 * | 3/2005 | Huang et al. | 338/22 R |
| 2002/0125982 | A1 * | 9/2002 | Swensen et al. | 338/22 R |
| 2002/0140540 | A1 * | 10/2002 | Chen et al. | 338/22 R |
| 2004/0027230 | A1 * | 2/2004 | Chiang et al. | 338/22 R |
| 2004/0090304 | A1 * | 5/2004 | Hetherton et al. | 338/22 R |
| 2004/0246092 | A1 * | 12/2004 | Graves et al. | 338/22 R |

* cited by examiner

*Primary Examiner*—Tu Hoang
(74) *Attorney, Agent, or Firm*—Seyfarth Shaw LLP

(57) ABSTRACT

An over-current protection apparatus comprises a plurality of over-current protection devices and a bonding sheet. Each over-current protection device comprises at least one current-sensitive element, two outer electrode layers and at least one insulating layer disposed on a surface of the current-sensitive element. The bonding sheet penetrates and connects the plurality of over-current protection devices, and is disposed on a surface of the at least one current-sensitive element for insulation.

13 Claims, 5 Drawing Sheets

OVER-CURRENT PROTECTION APPARATUS

BACKGROUND OF THE INVENTION (A) Field of the Invention

The present invention is related to an over-current protection apparatus, and more specifically to an over-current protection apparatus of surface mount technology (SMT) type, which is in the form of a string or an array.

(B) Description of the Related Art

To prevent over-current or over-temperature from occurring in a circuitry, the current portable electronic appliances such as cellular phones, laptop computers, portable video cameras and personal digital assistants (PDAs) commonly are embedded with over-current protection apparatuses to prevent permanent damages to the internal circuitries owing to electrical surge. Therefore, an over-current protection apparatus is serially connected to the output or input end of a circuitry in need of protection, so as to prevent core circuit or battery from being damaged.

Most electronic devices generate heat during operation, inducing the temperatures thereof to continuously increase as time goes on. Moreover, some components may generate large transient current due to interference. If an over-current protection apparatus is not employed to respond to the increasing temperature, and the large current is not cut off by breaking down circuit and increasing resistance, the relevant core circuit or battery will change the nature owing to high temperature, resulting in permanent damage.

A usual over-current protection apparatus comprises a current-sensitive element which is essentially composed of conductive positive temperature coefficient (PTC) material, and thus is a PTC device. The resistance of a PTC device is sensitive to temperature variation, and can be kept extremely low at normal operation due to its low sensitivity to temperature variation so that the circuit can operate normally. However, if an over-current or an over-temperature event occurs, the resistance will immediately increase to a high resistance state (e.g., above $10^4$ ohm.) Therefore, the over-current will be reversely eliminated and the objective to protect a core circuit or a battery can be achieved. The PTC device may be made from polymer, i.e., the so-called polymeric positive temperature coefficient (PPTC.) Owing to the function of current-sensitivity and the nature of polymer, the over-current protection apparatus has both over-current and over-temperature protective capabilities.

A known over-current protection apparatus 10 is shown in FIG. 1. It comprises a current-sensitive layer 11, two inner electrode layers 12, two insulating layers 13, two solder-mask layers 14 and two outer electrode layers 15. The two inner electrode layers 12 are respectively disposed on the upper and lower surfaces of the current-sensitive layer 11 to form a current-sensitive element 16 of a sandwich-like structure. The current-sensitive layer 11 comprises conductive PPTC material, and thus the current-sensitive element 16 is a PPTC element also. The insulating layers 13 are respectively disposed on the upper and lower surfaces of the current-sensitive element 16 for insulation and heat conduction. The solder-mask layers 14 and outer electrode layers 15 are disposed on the surfaces of the insulating layers 13, and serve as solder-masks and bonding pads for being soldered to a printed circuit board. The sidewalls of the over-current protection apparatus 10 are provided with semi-cylindrical conductive holes 17 so as to electrically connect the upper and lower outer electrode layers 15 and the upper and lower inner electrode layers 12, where the conductive holes 17 can be made by electroplating or spreading conductive paste for electrical conduction.

The known over-current protection apparatus 10 is a single device. However, multiple devices can be installed to a printed circuit board as requested. The single device can be soldered to the printed circuit board by dipping or SMT. As usual, mass production and high density installation are employed by SMT.

Other ordinary types of over-current protection apparatuses are disclosed in U.S. Pat. Nos. 6,377,467, 5,852,397 and 6,023,403. As mentioned above, more over-current protection apparatuses are needed to protect electronic products with higher and higher integration. However, too many discrete single devices waste space of a system.

SUMMARY OF THE INVENTIION

The objective of the present invention is to provide an over-current protection apparatus comprising a plurality of over-current protection devices connected by a bonding sheet. The over-current protection apparatus can be of various string or array types as required, so as to meet various requirements for being soldered to a printed circuit board. Moreover, the issue of discrete over-current devices can be resolved, thereby the space utilization is enhanced and the installation cost is lowered.

The over-current protection apparatus set forth in the present invention comprises a plurality of over-current protection devices and a bonding sheet. Each over-current protection device comprises at least one current-sensitive element, two outer electrode layers and at least one insulating layer disposed on a surface of the current-sensitive element. The bonding sheet penetrates and connects the plurality of over-current protection devices, and is in contact with a surface of the at least one current-sensitive element for insulation.

In other words, the over-current protection apparatus set forth in the present invention is a string or an array of multiple over-current protection devices which are connected by a bonding sheet. The bonding sheet is equivalent to an extension of an insulating layer of every over-current protection device, so that the bonding sheet functions as an insulating layer also.

The bonding sheet is usually close to the bottoms of the over-current protection devices for the convenience of cutting. Nevertheless, if the over-current protection device comprises two current-sensitive elements, the bonding sheet can be disposed therebetween to increase the mechanical strength.

DETAILED DESCRIPTION OF THE INVENTION

Figure 1:
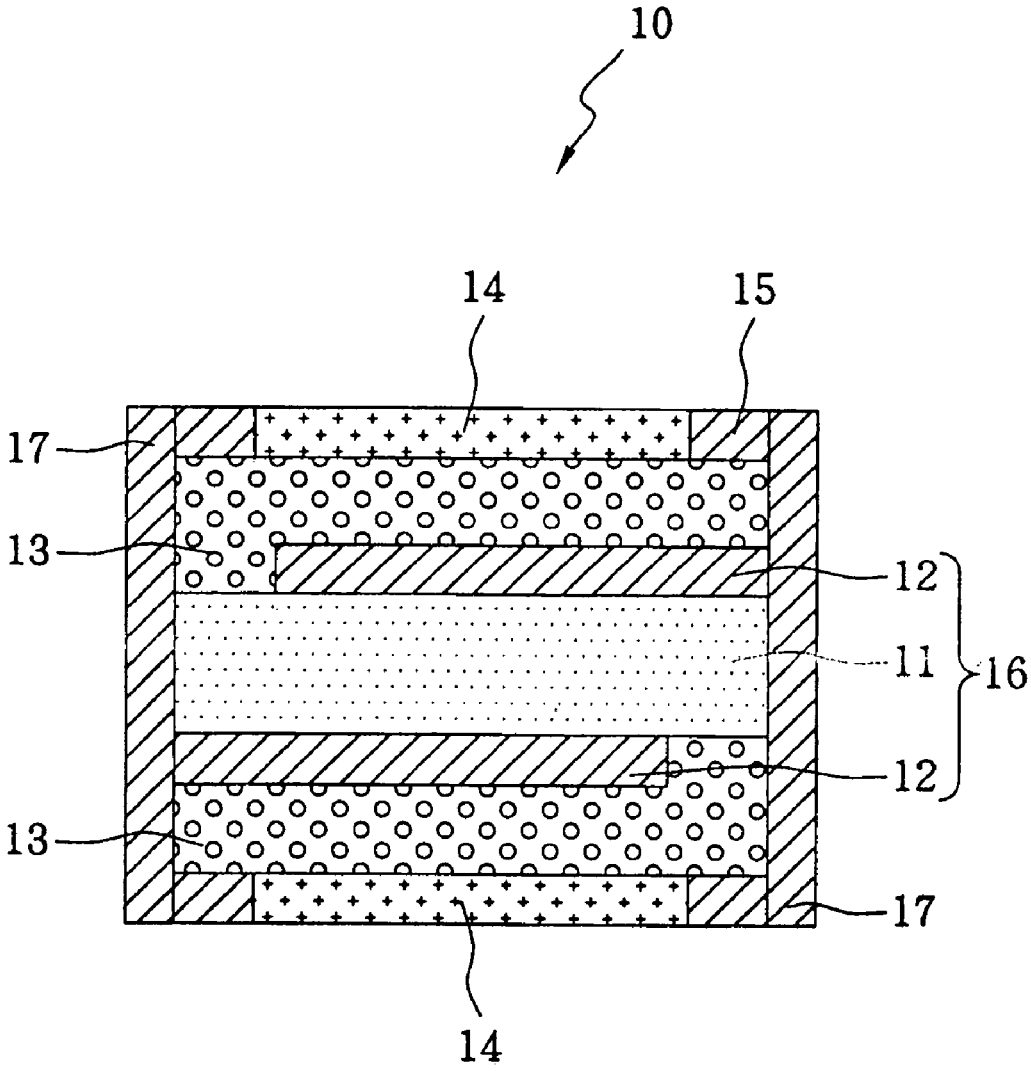
FIG. 1 (Background Art)
FIG. 1 illustrates a known over-current protection device.
Figure 2A:
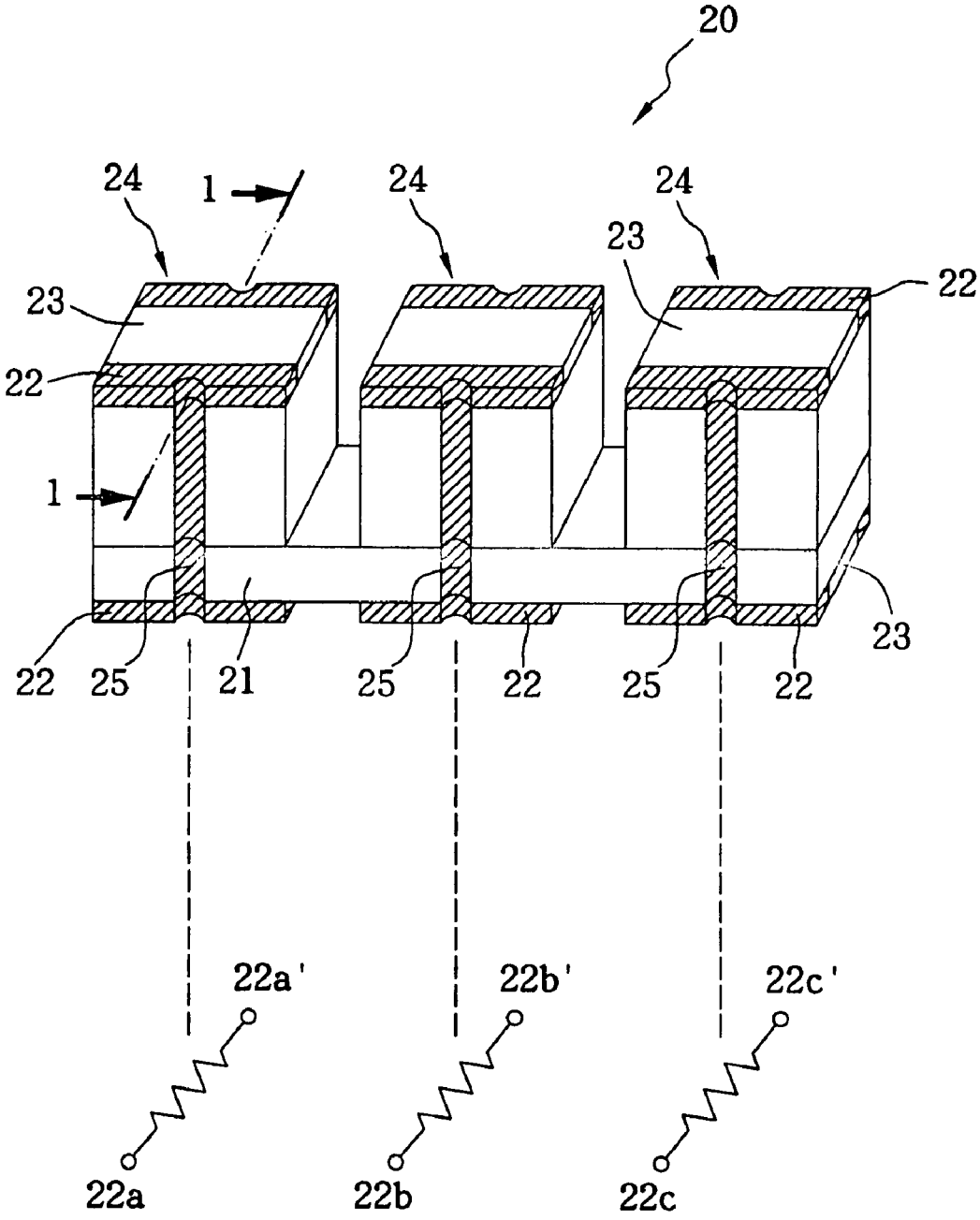
FIG. 2*a* illustrates an over-current protection apparatus of an embodiment in accordance with the present invention and the schematic diagram thereof.

FIG. 2*a* illustrates an over-current protection apparatus 20 and the schematic diagram thereof. The over-current protection apparatus 20 comprises a bonding sheet 21 and a plurality of over-current protection devices 24 which are electrically independent, (three over-current protection devices 24 are employed as an example herein,) where the plurality of over-current protection devices 24 are connected in series near the bottom thereof by the bonding sheet 21. Each over-current protection device 24 has upper and lower outer electrode layers 22 serving as end electrodes and solder-mask layers 23, where a semi-cylindrical conductive hole 25 connects the upper and lower outer electrode layers 22. A schematic diagram of the over-current protection apparatus 20 is illustrated in FIG. 2*a* also, wherein each resistance corresponds to each over-current protection device, individually, and the end electrodes of the resistances are denoted by 22*a*, 22*a*', 22*b*, 22*b*', 22*c* and 22*c*'.

Figure 2B:
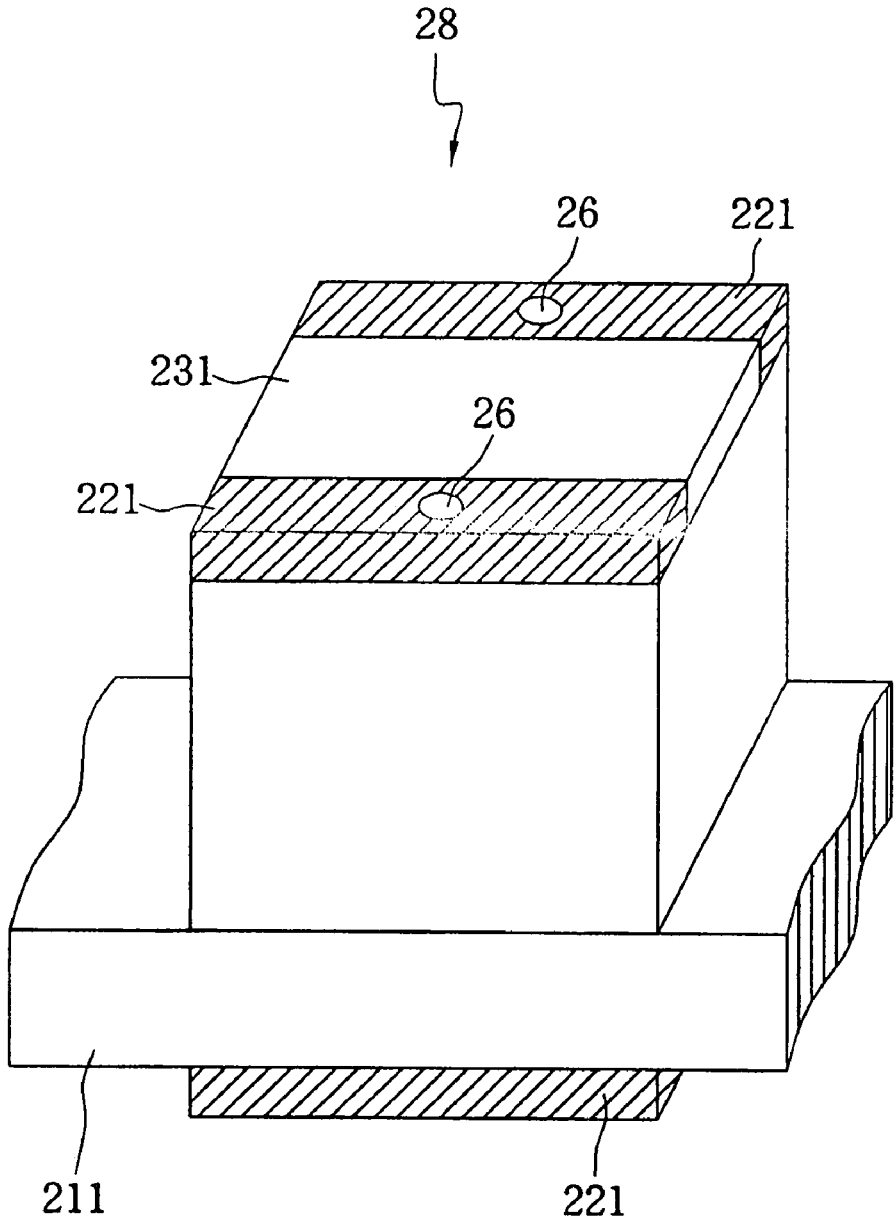
FIG. 2*b* illustrates an over-current protection device included in the over-current protection apparatus in accordance with the present invention.

The type of conductive holes connecting the upper and lower outer electrode layer is not limited. FIG. 2*b* illustrates an over-current protection device 28 of another type, which uses cylindrical conductive holes 26 to electrically connect upper and lower outer electrode layers 221. The over-current protection device 28 also comprises solder-mask layers 231, and a bonding sheet 211 for connection.

When the over-current protection apparatus 20 or 28 is soldered to a printed circuit board, liquid tin solder is adhered to the surfaces of the semi-cylindrical or cylindrical conductive holes 25 or 26 by capillary effect, so as to electrically connect the upper and lower outer electrode layers 22 or 221. Consequently, the solderability can be increased for SMT, thereby the over-current protection apparatus 20 or 28 can be well electrically connected to the ambient components, so the reliability thereof can be increased.

Figure 3:
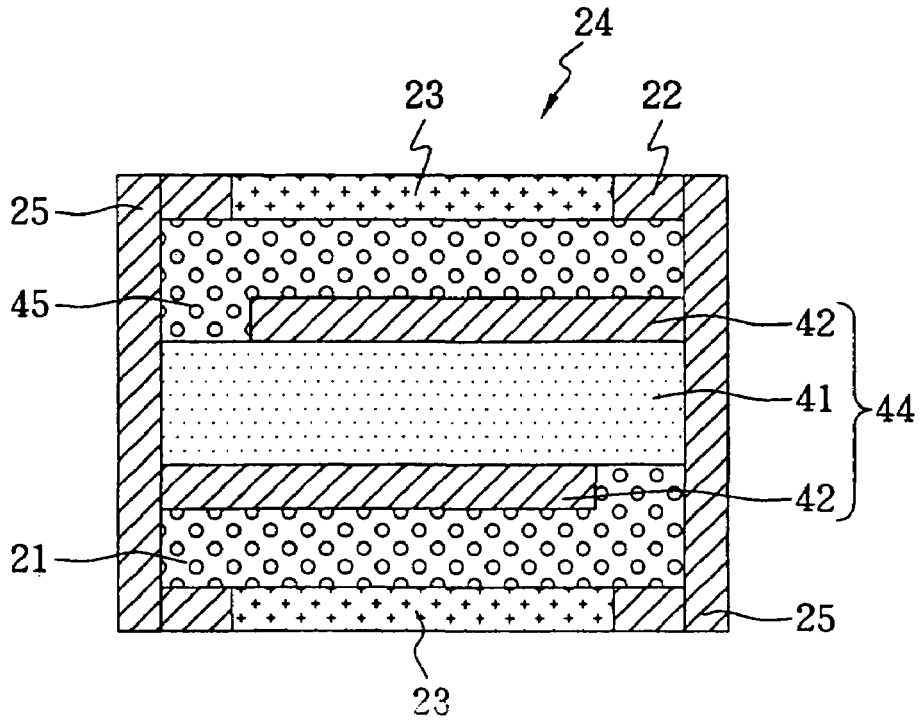
FIG. 3 is the cross-sectional view along the line 1—1 in FIG. 2*a;*

FIG. 3 is the cross-sectional view along the line 1—1 of the over-current protection device 24 shown in FIG. 2*a*. The over-current protection device 24 comprises a current-sensitive layer 41, two inner electrode layers 42, an insulating layer 45, two solder-mask layers 23, two outer electrode layers 22 and part of the bonding sheet 21. The two inner electrode layers 42 are respectively disposed on the upper and lower surfaces of the current-sensitive layer 41 to form a sandwich-like current-sensitive element 44. Because the current-sensitive layer 41 comprises conductive PPTC material, the current-sensitive element 44 is a PPTC element as well. The insulating layer 45 and the bonding sheet 21 are disposed on the upper and lower surfaces of the current-sensitive element 44 for insulation and heat conduction. The solder-mask layers 23 and outer electrode layers 22, respectively serving as solder masks and bonding pads for being soldered to a printed circuit board, are disposed on the surfaces of the insulating layer 45 and bonding sheet 21. The sidewalls of the over-current protection device 24 are provided with semi-cylindrical conductive holes 25 for connecting the upper and lower outer electrode layers 22 and inner electrode layers 42. The conductive holes 25 can be electroplated by metal or spread by conductive paste for electrical conduction.

The thickness of the bonding sheet 21 depends on the number of over-current protection devices 24. More over-current protection devices 24 need thicker bonding sheet for sufficient support. The thickness of the bonding sheet 21 is approximately 1 mm, and in consequence the bonding sheet 21 can support three over-current protection devices 24. If the over-current protection apparatus 20 comprises more over-current protection devices 24, the thickness of the bonding sheet 21 should be larger than 1 mm. Generally, the bonding sheet 21 and the insulating layer 45 are made of the same material, e.g., pre-preg or ceramic laminate. In addition to connecting the plurality of over-current protection devices 24, the bonding sheet 21 further provides heat dissipation and insulation functions.

Figure 4:
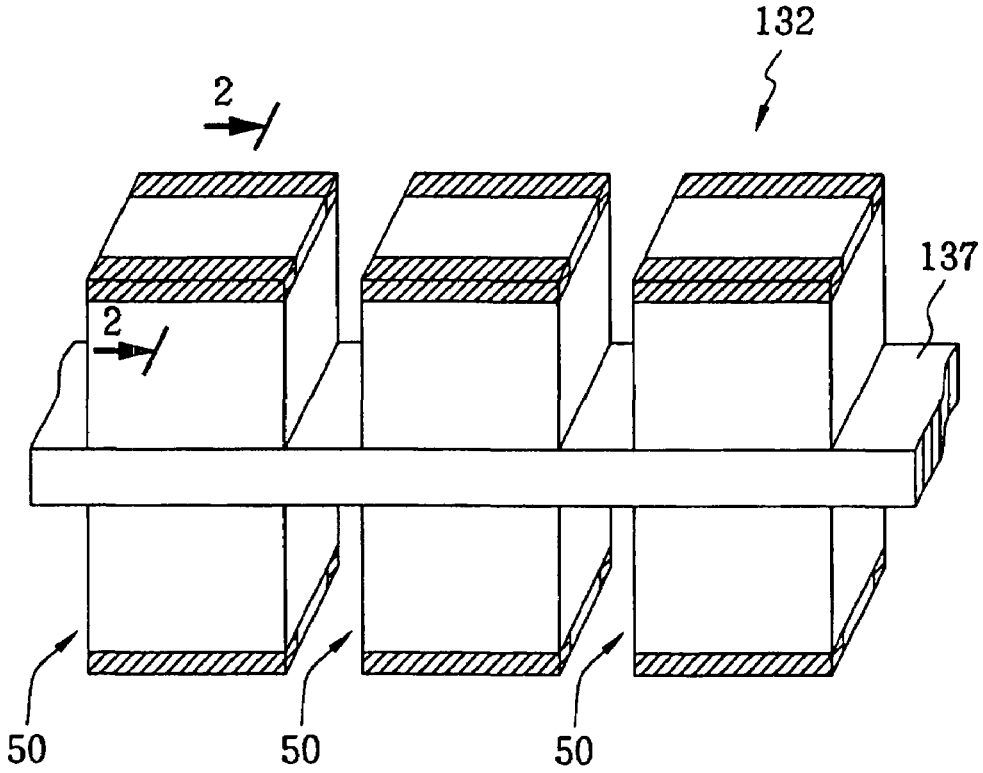
FIG. 4 illustrates an over-current protection apparatus of another embodiment in accordance with the present invention.
Figure 5:
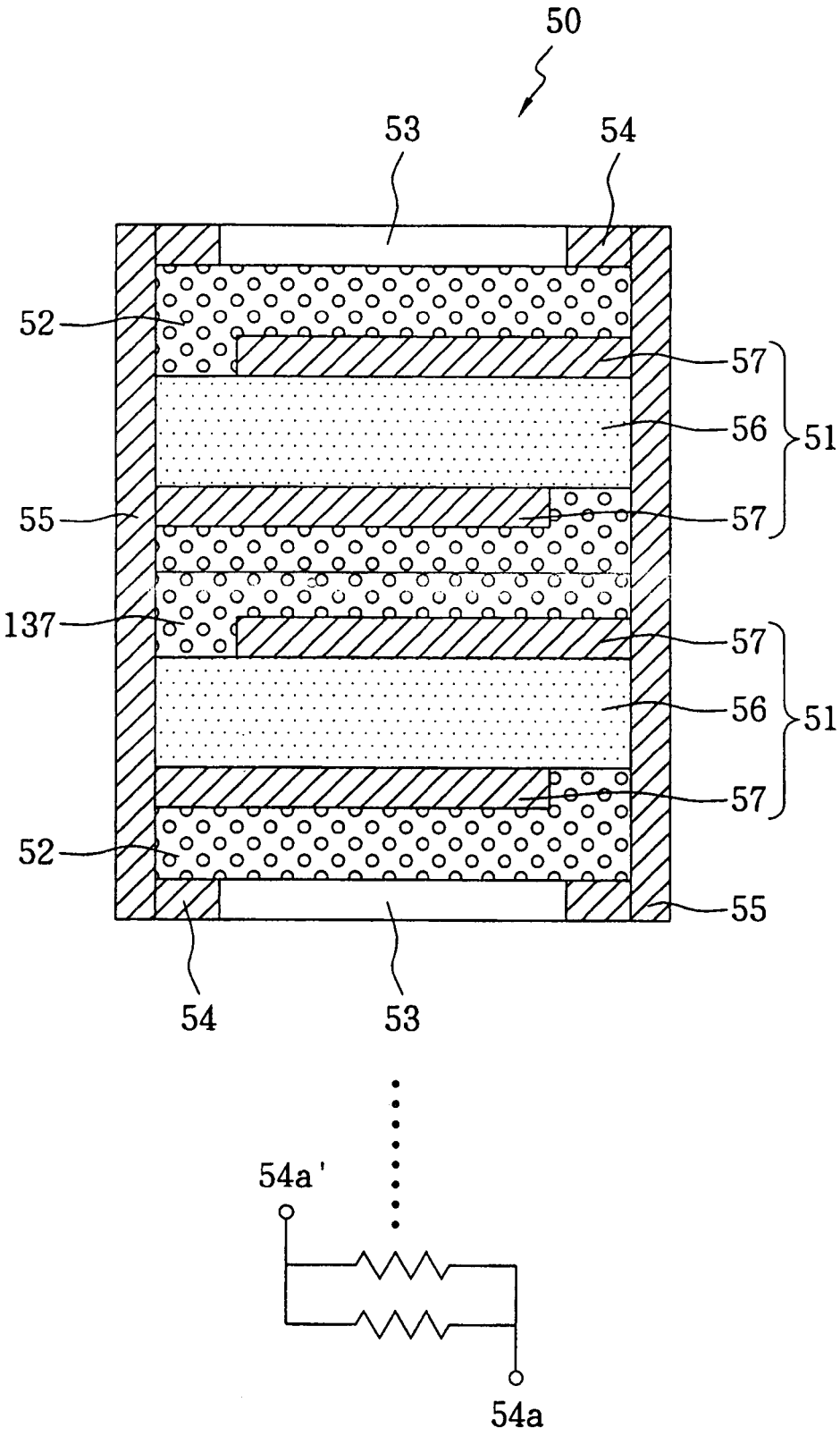
FIG. 5 is the cross-sectional view along the line 2—2 in FIG. 4.

FIG. 4 illustrates an over-current protection apparatus 132 of another embodiment and the schematic diagram thereof, and FIG. 5 is the cross-sectional view along the line 2—2 in FIG. 4. The over-current protection apparatus 132 comprises three over-current protection devices 50 that are connected by a bonding sheet 137. The over-current protection device 50 comprises two PPTC elements 51 (each includes a current-sensitive layer 56 and two inner electrode layers 57), two insulating layers 52, a part of the bonding sheet 137, two solder-mask layers 53 and two outer electrode layers 54. The bonding sheet 137 basically provides equivalent function as the insulating layer 52, and further connects and support the multiple over-current protection devices 50. The two outer electrode layers 54 are stacked on the surfaces of the insulating layers 52 as two terminals, and are electrically connected to the two PPTC elements 51 by the two conductive holes 55. The portion of the insulating layer 52 uncovered by the outer electrode layer 54 is overlaid by the solder-mask layer 53. In FIG. 5, the schematic diagram of the over-current protection device 50 shows two resistances in parallel, which can reduce the normal resistance, wherein 54*a* and 54*a*' are the two ends of the circuit and correspond to the two outer electrode layers 54. In comparison with that shown in FIG. 2*a* and 3, the over-current protection device 50 comprises multiple PPTC elements 51, and the bonding sheet 137 serving as an insulator is formed therebetween for connection.

In fact, the lower insulating layer of the over-current protection device comprising multiple PPTC elements can extend to be a bonding sheet also; it depends the actual requirement and situation.

As shown in FIGS. 2*a* and 4, a bonding sheet can connect multiple over-current protection devices in the form of a string. The number of the over-current protection devices and the number of the including PPTC elements are not limited; they all depend upon the actual requirement.

In addition to employ over-current protection devices of normal size, the over-current protection apparatus of the present invention can use smaller devices. Therefore, the over-current protection apparatus is more suitable for SMT, so that it is valuable for production.

As mentioned above, the over-current protection devices may be connected in the form of a string whose size depending upon actual requirements. Further, the over-current protection device can adjust the number of the containing current-sensitive elements to obtain the required resistance. When the over-current protection apparatus is soldered to a printed circuit board by SMT, it seems that a multi-pad device is connected to ambient components. Consequently, the footprint of the over-current protection apparatus becomes smaller and the throughput is increased in mass production, so the cost can be decreased effectively.

The above-described embodiments of the present invention are intended to be illustrative only. Numerous alternative embodiments may be devised by those skilled in the art without departing from the scope of the following claims.

What is claimed is:

1. An over-current protection apparatus, comprising:

at least three over-current protection devices electrically insulated from each other, wherein each over-current protection device comprises:

(a) a current-sensitive element;

(b) an insulating layer disposed on a first surface of the current-sensitive element; and (c) two outer electrode layers; and a bonding sheet penetrating through and connecting each of the over-current protection devices and being disposed on a second surface of the current-sensitive element of each over-current protection device for insulation.

2. The over-current protection apparatus in accordance with claim 1, wherein the two outer electrode layers are electrically connected to the current-sensitive element.

3. The over-current protection apparatus in accordance with claim 1, wherein the current-sensitive element comprises a current-sensitive layer and two inner electrode layers.

4. The over-current protection apparatus in accordance with claim 1, wherein the bonding sheet is a ceramic laminate.

5. The over-current protection apparatus in accordance with claim 1, wherein the bonding sheet is made of pre-preg.

6. The over-current protection apparatus in accordance with claim 1, wherein the two outer electrode layers are electrically connected to the current-sensitive element by at least one semi-cylindrical conductive hole.

7. The over-current protection apparatus in accordance with claim 1, wherein the two outer electrode layers are electrically connected to the current-sensitive element by at least one cylindrical conductive hole.

8. An over-current protection apparatus, comprising:

at least three over-current protection devices electrically insulated from each other, wherein each over-current protection device comprises:

(a) at least two current-sensitive elements;

(b) at least one insulating layer disposed on a first surface of the at least two current sensitive elements; and (c) two outer electrode layers; and a bonding sheet penetrating through and connecting each of the at least three over-current protection devices and being disposed on a second surface of the at least two current-sensitive elements for insulation.

9. The over-current protection apparatus in accordance with claim 8, wherein the at least two current-sensitive elements are disposed on different sides of the bonding sheet, respectively.

10. The over-current protection apparatus in accordance with claim 8, wherein the bonding sheet is a ceramic laminate.

11. The over-current protection apparatus in accordance with claim 8, wherein the bonding sheet is made of pre-preg.

12. The over-current protection apparatus in accordance with claim 1, wherein the bonding sheet is between the current-sensitive element and one of the two outer electrodes of each over-current protection device.

13. The over-current protection apparatus in accordance with claim 8, wherein the bonding sheet is between the two current-sensitive elements.

* * * * *